US006535701B2

(12) United States Patent
Baba

(10) Patent No.: US 6,535,701 B2
(45) Date of Patent: Mar. 18, 2003

(54) FIXING DEVICE HAVING SHORTENED STANDBY PERIOD

(75) Inventor: Toshihiko Baba, Chiba (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/892,623

(22) Filed: Jun. 28, 2001

(65) Prior Publication Data

US 2002/0031362 A1 Mar. 14, 2002

(30) Foreign Application Priority Data

Jun. 30, 2000 (JP) ..... 2000-199806
May 21, 2001 (JP) ..... 2001-150424

(51) Int. Cl.[7] ..... G03G 15/20

(52) U.S. Cl. ..... 399/69; 219/216; 399/70; 399/328

(58) Field of Search ..... 399/33, 67, 69, 399/70, 320, 328, 329, 330, 31; 219/216; 432/59, 60

(56) References Cited

U.S. PATENT DOCUMENTS

| | | | | |
|---|---|---|---|---|
| 4,737,818 A | * | 4/1988 | Tanaka et al. | 399/70 |
| 5,329,343 A | * | 7/1994 | Saito | 399/70 |
| 5,701,554 A | * | 12/1997 | Tanaka et al. | 399/69 |
| 5,923,930 A | | 7/1999 | Tsukamoto et al. | 399/237 |
| 6,018,140 A | * | 1/2000 | Hirose et al. | 399/69 X |
| 6,055,390 A | | 4/2000 | Kurotaka et al. | 399/69 |
| 6,078,766 A | | 6/2000 | Kurotaka | 399/165 |
| 6,088,558 A | | 7/2000 | Yamada et al. | 399/165 |
| 6,108,906 A | | 8/2000 | Fujita et al. | 29/895.211 |
| 6,115,576 A | | 9/2000 | Nakano et al. | 399/302 |
| 6,122,479 A | | 9/2000 | Fujita et al. | 399/333 |
| 6,198,888 B1 | | 3/2001 | Kurotaka et al. | 399/69 |
| 6,243,559 B1 | | 6/2001 | Kurotaka et al. | 399/329 |
| 6,262,787 B1 | | 7/2001 | Kamoi et al. | 349/96 |
| 6,295,435 B1 | | 9/2001 | Shinohara et al. | 399/301 |
| 6,347,212 B1 | | 2/2002 | Kosugi et al. | 399/348 |
| 6,366,751 B1 | | 4/2002 | Shakuto et al. | 399/159 |

FOREIGN PATENT DOCUMENTS

| | | |
|---|---|---|
| JP | 7-219382 | 8/1995 |
| JP | 10-104990 | 4/1998 |

OTHER PUBLICATIONS

U.S. patent application Ser. No. 09/509,127, filed Sep. 28, 1998.
U.S. patent application Ser. No. 09/009,306, filed Jan. 20, 1998, pending.
U.S. patent application Ser. No. 09/698,035, filed Oct. 30, 2000, pending.
U.S. patent application Ser. No. 09/874,990, filed Jun. 7, 2001, pending.
U.S. patent application Ser. No. 09/892,623, filed Jun. 28, 2001, pending.

(List continued on next page.)

*Primary Examiner*—Hoan Tran
(74) *Attorney, Agent, or Firm*—Oblon, Spivak, McClelland, Maier & Neustadt. P.C.

(57) ABSTRACT

At startup operation of a fixing device, a standby period during which a fixing belt and a pressure roller are heated until they reach a respective predetermined target temperature is shortened by heating the fixing belt to a temperature which is higher than the target temperature. In the fixing device, the fixing belt is spanned around an opposing roller and a heating roller. A pressure roller is provided in press-contact with the opposing roller via the fixing belt. A heater heats the fixing belt and the pressure roller so that temperatures of the fixing belt and the pressure roller reach a target temperature suitable for fixing a toner image. A recording material is conveyed through the rotating fixing belt and pressure roller to fix the toner image onto the recording material by heat and pressure.

33 Claims, 8 Drawing Sheets

OTHER PUBLICATIONS

U.S. patent application Ser. No. 09/951,510, filed Sep. 14, 2001, pending.
U.S. patent application Ser. No. 09/966,075, filed Oct. 1, 2001, pending.
U.S. patent application Ser. No. 10/028,767, filed Dec. 28, 2001, pending.
U.S. patent application Ser. No. 10/028,769, filed Dec. 28, 2001, pending.
U.S. patent application Ser. No. 10/021,503, filed Dec. 19, 2001, pending.
U.S. patent application Ser. No. 10/059,366, filed Jan. 31, 2002, pending.
U.S. patent application Ser. No. 10/158,852, filed Jun. 6, 2002, pending.

* cited by examiner

FIXING DEVICE HAVING SHORTENED STANDBY PERIOD

BACKGROUND OF THE INVENTION

1. Field of the Invention

The present invention relates to a fixing device to be used in an image forming apparatus, and more particularly to the fixing device that can perform a startup operation in a short period of time.

2. Discussion of the Background

A fixing device, which includes a fixing member, a heater to heat the fixing member, a pressing member in press-contact with the fixing member, and a temperature detector to detect a temperature of the fixing member, is commonly known. In the fixing device, energization of the heater is controlled such that the temperature of the fixing member reaches a target temperature based on a detection result of the temperature detector. A recording material bearing an image passes through between the rotating fixing member and the pressing member to fix the image onto the recording material by heat and pressure. The above-described fixing device is commonly used in a multifunctional image forming apparatus having a copier function, a printer function, and a facsimile function, or having at least two of these functions.

In this type of fixing device, the fixing member is heated at a startup period of the fixing device during which the fixing member is heated until it is stably maintained approximately at a target temperature after power to the image forming apparatus is turned on and the heater for the fixing member is energized. When it is detected that the temperature of the fixing member reaches the target temperature, the fixing member and the pressing member start a pre-rotation to make the temperatures of these members uniform before staring a fixing operation of a toner image. When a heater to heat the pressing member is provided, the pressing member is also heated by the heater during a startup period of the fixing device. The fixing member and the pressing member start the pre-rotation when the temperatures of the fixing member and the pressing member reach a respective target temperature suitable for fixing a toner image. When the pre-rotation is started, heat of the fixing member is largely absorbed by the pressing member because the temperature of the pressing member is lower than that of the fixing member. Therefore, the temperature of the fixing member falls below the target temperature again. Thus, the heater keeps on heating the fixing member after the fixing member starts a pre-rotation. When the heater to heat the pressing member is provided, the pressing member is also heated by the heater. When it is detected that the temperatures of the fixing member and the pressing member reach the respective target temperature or higher, the startup operation of the fixing device is finished.

However, when a temperature of the fixing member is controlled at a startup of a fixing device, a longer period of time is required for the startup operation of the fixing device i.e., a longer standby period is required, by which a user is inconvenienced.

SUMMARY OF THE INVENTION

The present invention has been made in view of the above-mentioned and other problems and addresses the above-discussed and other problems.

The present invention advantageously provides a novel fixing device wherein a standby period at startup of the fixing device is shortened.

According to an example of the present invention, a fixing device includes a fixing member; a pressing member configured to be in press-contact with the fixing member, wherein the fixing member and the pressing member sandwich a recording material bearing a toner image therebetween while rotating to fix the toner image onto the recording material by heat and pressure; a primary temperature detector configured to detect a temperature of the fixing member; and a primary heater configured to heat the fixing member, wherein energization of the primary heater is controlled such that the temperature of the fixing member reaches a target temperature suitable for fixing a toner image based on a detection result of the primary temperature detector. At startup of the fixing device, the energization of the primary heater is controlled such that the temperature of the fixing member reaches a startup temperature that is higher than the target temperature, and a rotation of the fixing and pressing members is controlled such that the fixing and pressing members start a pre-rotation when the primary temperature detector detects that the temperature of the fixing member reaches the startup temperature.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
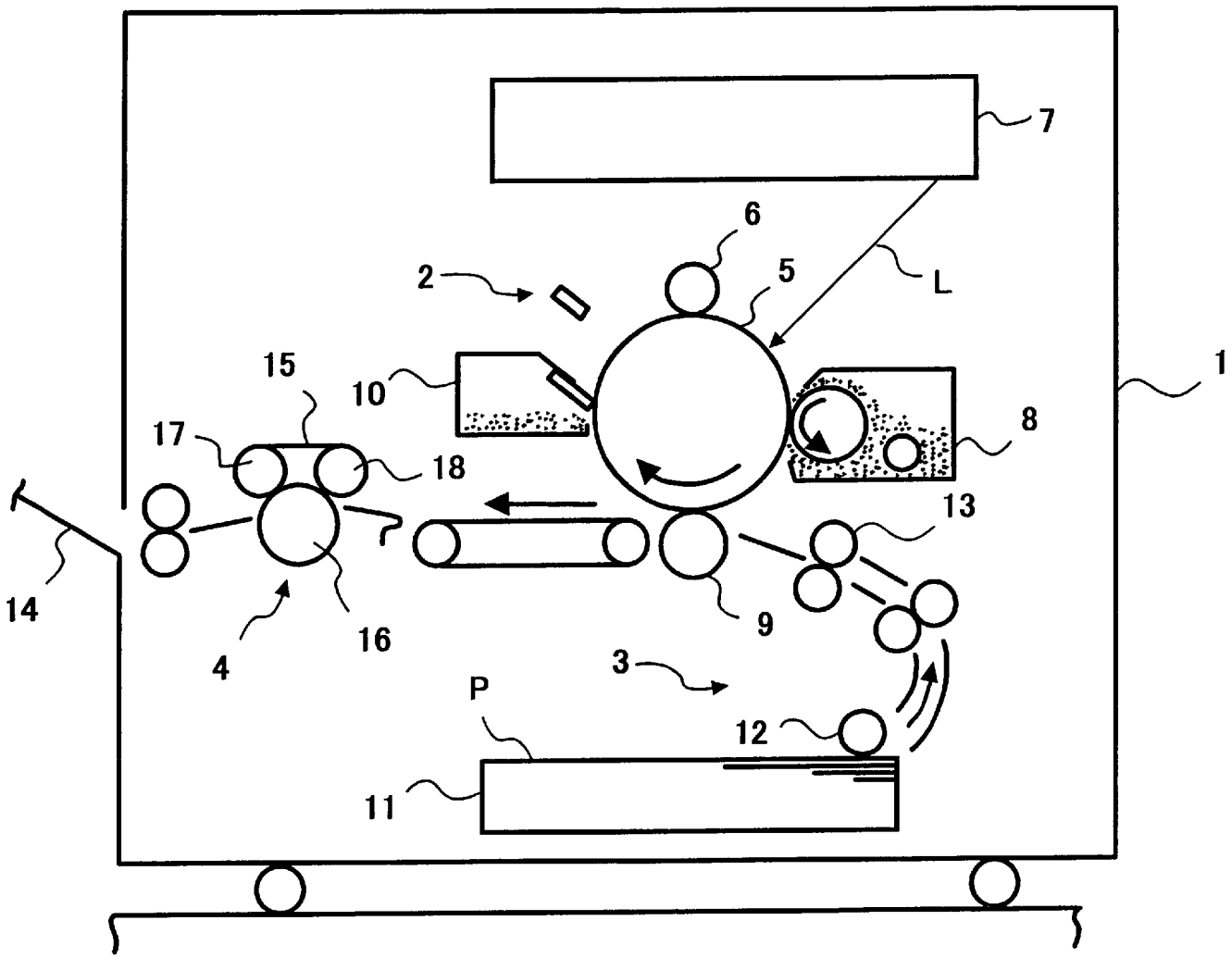
FIG. 1 is a schematic sectional view illustrating an exemplary construction of an image forming apparatus.

Referring now to the drawings, wherein like reference numerals designate identical or corresponding parts throughout the several views, FIG. 1 is a vertical sectional view schematically illustrating an exemplary construction of an image forming apparatus. A main body of the image forming apparatus 1 includes an image forming device 2, a feeding device 3, and a fixing device 4. The image forming device forms a toner image on a recording material. The feeding device supplies the image forming device 2 with the recording material. The fixing device 4 fixes the toner image formed on the recording material. An outline of the image forming device 2 is now described below.

The image forming device 2 includes a drum-shaped photoconductive element 5 as an example of an image bearing member. A surface of the photoconductive element 5 is charged in a predetermined polarity by a charging unit 6 when the photoconductive element 5 rotates in a clockwise direction. A laser writing unit 7, which is an example of an exposure unit, irradiates the charged surface of the photoconductive element 5 with laser beam light L modulated according to image data to form an electrostatic latent image on the surface of the photoconductive element 5.

The electrostatic latent image is developed into a visible image with toner by a developing unit 8. A transfer unit 9 transfers the toner image onto the recording material conveyed by the feeding device 3. A cleaning unit 10 removes residual toner remaining on the surface of the photoconductive element 5 after the toner image has been transferred onto the recording material.

The feeding device 3 includes a cassette 11 which contains a recording material P including, for example, a sheet-like transfer paper. The recording material P is fed from the cassette 11, sheet-by-sheet starting from that placed at the top of the stacked recording material P, by a rotation of a conveying roller 12. The recording material P is then conveyed to a transfer section positioned between the photoconductive element 5 and the transfer unit 9 by a rotation of a pair of registration rollers 13.

The recording material P carrying the toner image is conveyed to the fixing device 4 where the toner image on the recording material P is fixed. The recording material P is then discharged to an exit tray 14.

Figure 2:
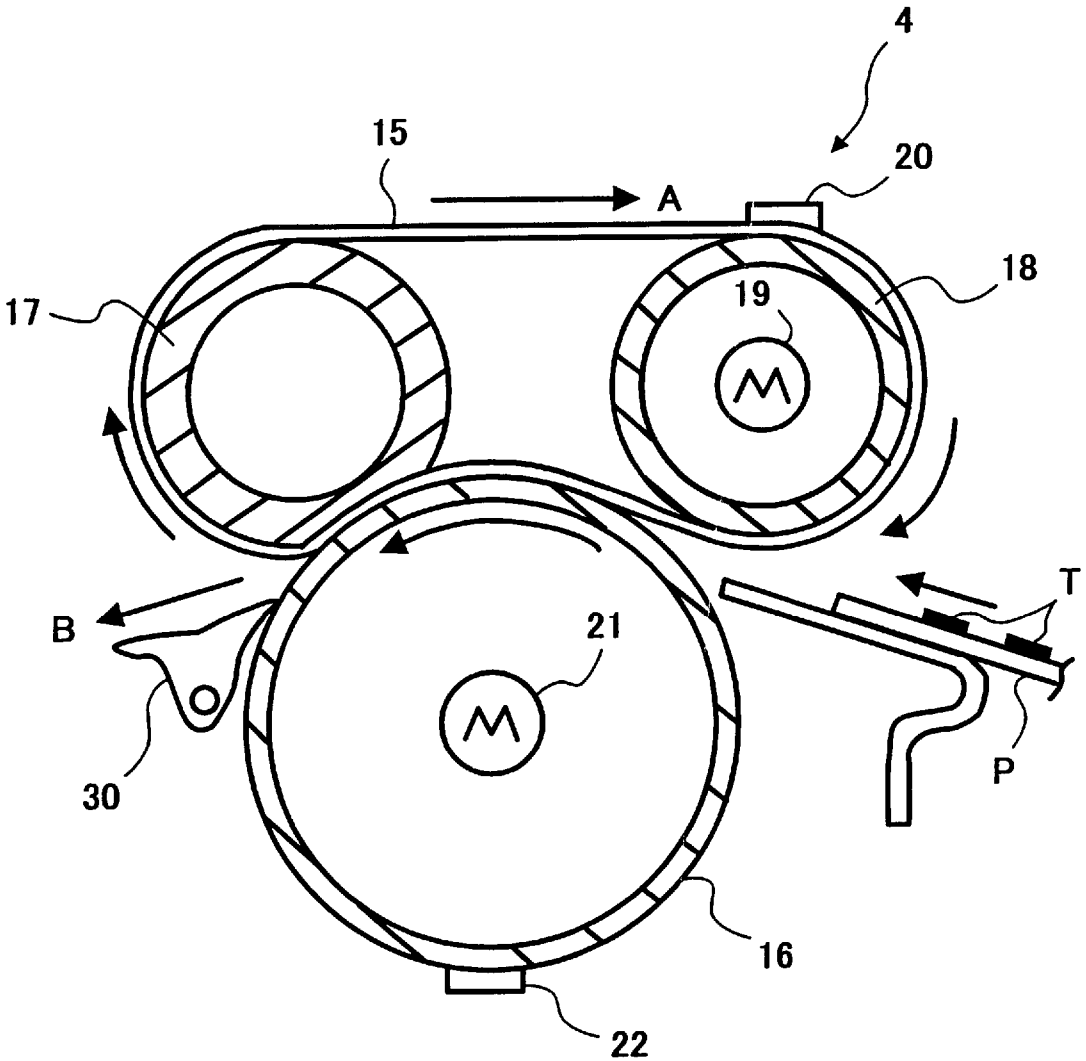
FIG. 2 is an enlarged sectional view of a fixing device illustrated in FIG. 1.

FIG. 2 is an enlarged sectional view of the fixing device 4. The fixing device 4 includes a fixing belt 15 in an endless form as an example of a fixing member and a cylindrical-shaped pressure roller 16 as an example of a pressing member which is in press contact with the fixing belt 15. The fixing device 4 further includes a cylindrical-shaped opposing roller 17 located at a position opposed to the pressure roller 16 and a heating roller 18. The fixing belt 15 is spanned around the heating roller 18 and the opposing roller 17. The heating roller 18 is also cylindrically shaped, and a heater 19 to heat the fixing belt 15 is provided inside the heating roller 18.

A thermistor 20 abuts against an outer surface of the fixing belt 15 at a position where a corresponding inner surface of the fixing belt 15 begins to be wound around the hearing roller 18. The thermistor 20 is disposed at the center of the fixing belt 15 in a cross-direction. The thermistor 20 is an example of a temperature detector for detecting a temperature of the fixing member. The heating roller 18 heated by the heater 19 conveys heat to the fixing belt 15 to heat the fixing belt 15. The heating roller 18 also serves as a tension roller to apply a tension to the fixing belt 15.

The above-described heater to heat the fixing belt 15 is referred to as a primary heater. In the fixing device 4, a secondary heater is provided inside of the pressure roller 16 to heat the pressure roller 16, in addition to the primary heater. Hereinafter, the heater 21 is referred to as the secondary heater. For example, halogen heaters may be used as the primary and secondary heaters 19 and 21.

The above-described temperature detector 20 to detect a temperature of the fixing member is referred to as a primary temperature detector. The fixing device 4 includes a secondary temperature detector to detect a temperature of the pressing member. Hereinafter, a thermistor 22 provided to detect a temperature of a surface of the pressure roller 16 is referred to as the secondary temperature detector.

The fixing device 4 includes the secondary heater to heat a pressing member and the secondary temperature detector to detect a temperature of the pressing member. However, the secondary heater and the secondary temperature detector, which are the secondary heater 21 and the secondary thermistor 22, can be omitted.

The pressure roller 16 press-contacts with the opposing roller 17 via the fixing belt 15. Thus, the pressure roller 16 press-contacts with the fixing belt 15 while curving the fixing belt 15 in a predetermined length in the circumferential direction.

In a fixing operation of a toner image, at least one roller among the pressure roller 16, the opposing roller 17, and the heating roller 18 is rotatably driven by a driving unit (not shown). The pressure roller 16 is rotated in a counterclockwise direction. The fixing belt 15 is then rotated in a direction indicated by an arrow A in FIG. 2. Thus, the opposing roller 17 and the heating roller 18 rotate in a clockwise direction in FIG. 2. The recording material P bearing an unfixed toner image T on its surface is conveyed, with the toner image T oriented to contact the fixing belt 15, to a position where the rotating pressure roller 16 press-contacts with the rotating fixing belt 15, i.e., a nip position as indicated by an arrow in FIG. 2.

The recording material P passes through the nip between the pressure roller 16 and the fixing belt 15. In the nip position, the recording material P is pressed by the fixing belt 15 and the pressure roller 16. At the same time, heat is applied to the recording material P by the fixing belt 15 and the pressure roller 16.

The toner image T on the recording material P, which abuts against a surface of the fixing belt 15, is fixed onto the recording material P by the heat and pressure. A separation pick 30 abuts against a surface of the pressure roller 16. The separation pick 30 separates the recording material P from the pressure roller 16 when the recording material P, which is conveyed while being pressed by the fixing belt 15 and the pressure roller 16, winds around the pressure roller 16.

When a toner image is fixed as described above, temperatures of surfaces of the fixing belt 15 and the pressure roller 16 are controlled so that target temperatures of T1 and T2, which are suitable temperatures for fixing a toner image, are maintained for the fixing belt 15 and the pressure roller 16, respectively.

Figure 3:
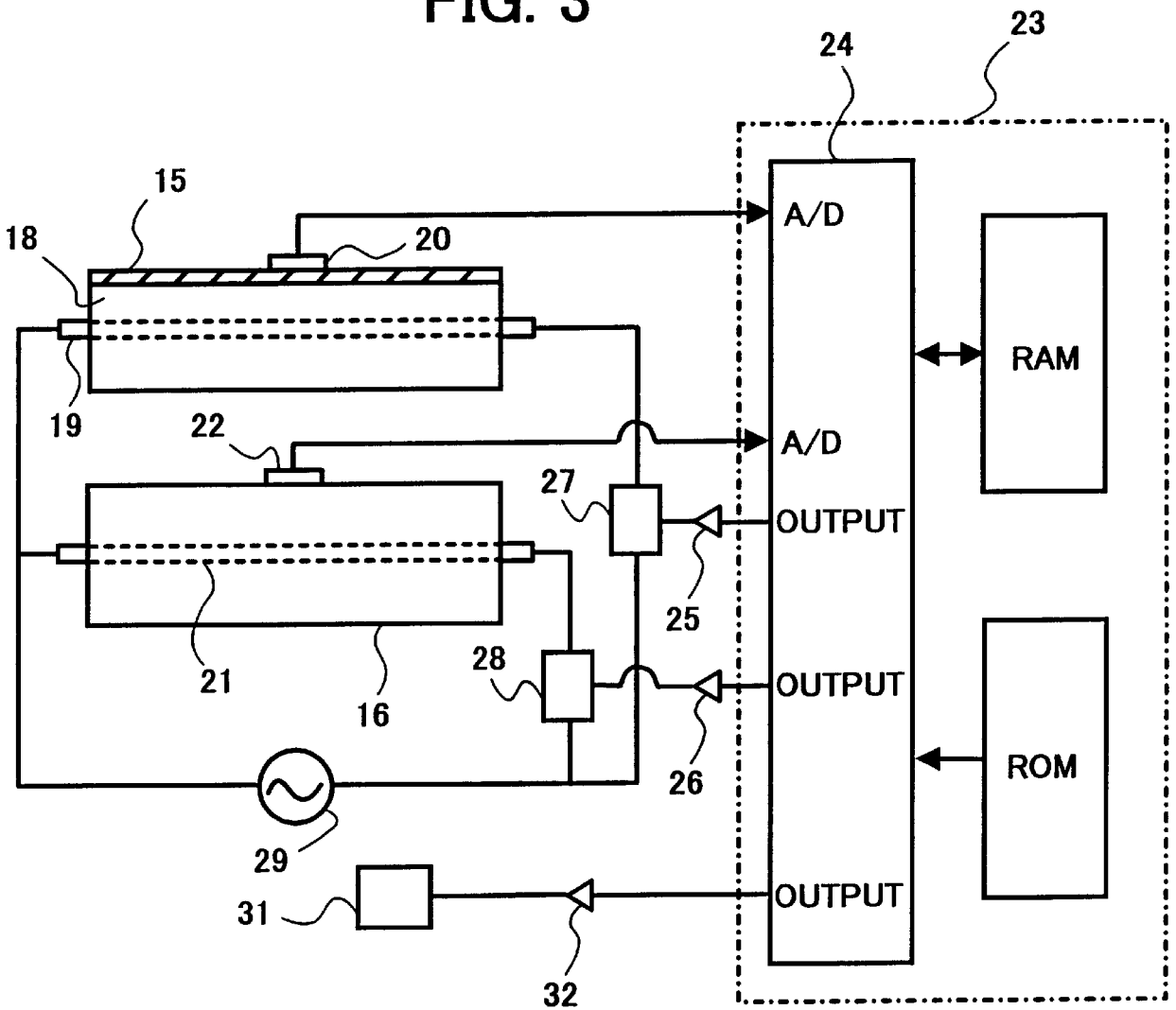
FIG. 3 is a block diagram illustrating a control system of the fixing device.

FIG. 3 is a block diagram illustrating an example of a controller to control the surface temperatures of the fixing belt 15 and the pressure roller 16. In FIG. 3, a microcomputer 23 includes a CPU 24. The CPU 24 outputs ON/OFF signals of each heater 19 and 21 to switching elements 27 and 28, respectively, via drivers 25 and 26 based on temperature detecting signals from the primary and secondary thermistors 20 and 22, which are connected to the CPU 24. Each switching element 27 and 28 controls on and off of a supply of a current from an alternating power 29 to the primary and secondary heaters 19 and 21.

The primary and secondary temperature detectors including the primary and secondary thermistors 20 and 22 detect a surface temperature of the fixing member including the fixing belt 15 and the pressing member including the pressure roller 16, respectively. A power supply to the primary and secondary heaters including the primary and secondary heaters 19 and 21 is controlled such that the temperatures of the fixing member and the pressing member reach the target temperature of T1 and T2, respectively, based on a result of the detection of the temperatures performed by the primary and secondary temperature detectors. The recording material P bearing the toner image T is conveyed while being pressed by the rotating fixing belt 15 and the pressure roller 16. The toner image is then fixed onto the recording material P by actions of heat and pressure.

For example, the fixing belt 15 includes a seamless belt substrate that includes a heat-resistant resin and a metal. For example, polyimide, polyamide imide, and polyether ether ketone (PEEK), etc., are used as the heat-resistant resin. Nickel, aluminum, and iron, etc., are used, for example, as the metal for the belt substrate. It is desirable that a thickness of the substrate is equal to or less than 100 $\mu$m in order to decrease a heat capacity of the belt substrate.

It is desired that a surface of the fixing belt 15 has a release effect so that the recording material P and toner do not adhere to the surface of the fixing belt 15, because the recording material P and the toner are in press-contact with the surface of the fixing belt 15. It is also desired that the fixing belt 15 is excellent in heat-resistance and durability. Therefore, the surface of the belt substrate of the fixing belt 15 is covered with a heat-resistant release layer such as a fluorine resin and a high release effect silicone rubber.

A surface release layer can be formed by spray coating the surface of the belt substrate with the fluorine resin and fusing the fluorine resin with heat. A level of fixing and a response to heat of a toner image is enhanced when a hardness of the high release effect silicone rubber is 25 to 65 degrees (in Japanese Industrial Standards A) and when a thickness of it is 100 to 300 $\mu$m.

The opposing roller 17 includes, for example, a core metal at its center and a heat-insulating elastic member covering the surface of the core metal. The heat-insulating elastic member includes a soft heat-resistant material such as a foam silicone rubber. A thickness of the heat-insulating elastic member is approximately 15% to 20% of the diameter of the opposing roller 17. By using such a heat-insulating elastic member, the opposing roller 17 press-contacts with the pressure roller 16 over a wide circumferential length. Thus, a sufficient amount of heat is applied to toner on the recording material P which is conveyed while being pressed by the opposing roller 17 and the pressure roller 16, resulting in an improved fixing performance.

The pressure roller 16 includes a core metal, such as aluminum, stainless steel, carbon steel, or the like and a release layer covering the surface of the core metal. The release layer includes is formed of a material such as fluorine resin, silicone rubber having high release effect, or the like. It is desirable that the release layer of the pressure roller 16 is configured to be harder than the surface of the opposing roller 17 such that the pressure roller 16 largely deforms the heat-insulating elastic member portion of the opposing roller 17 where the pressure roller 16 press-contacts via the fixing belt 15. With this arrangement, the recording material P, which is conveyed while being pressed by the fixing belt 15 and the pressure roller 16, is discharged in a downward direction as indicated by an arrow B in FIG. 2, resulting in a easier release of the recording material P from the surface of the fixing belt 15.

It is desired that the release layer of the pressure roller 16 is configured to have a thickness of less than 7% of the diameter of the pressure roller 16 and a hardness of 40-degree or greater in JIS A (Japanese Industrial Standards A). The heating roller 18 includes a metallic thin cylinder formed of a material such as aluminum, carbon steel, stainless steel, or the like.

Referring to FIG. 2, a fixing device according to an example of the present invention is now described below comparing with a prior art fixing device.

The pressure roller 16 includes an iron hollow roller having a thickness of 1 mm and a silicone rubber layer of 0.3 mm in thickness covering the surface of the iron hollow roller. The surface of the silicone rubber layer is coated with the fluorine resin of 20 $\mu$m in thickness. The heating roller 18 includes an aluminum hollow roller of 1 mm in thickness with an alumite treatment performed on the surface thereof.

The fixing belt 15 includes a nickel belt substrate of 40 $\mu$m in thickness and a silicon rubber layer of 150 $\mu$m in thickness covering the surface of the nickel belt substrate. The opposing roller 17 includes an aluminum core of 18 mm in diameter and silicon foam of 6 mm in thickness covering the surface of the aluminum core. Outer diameters of the pressure roller 16, the heating roller 18, and the opposing roller 17 are 40 mm, 30 mm, and 30 mm, respectively. A linear velocity of the fixing belt 15 is 200 mm/s.

A halogen heater of 790 watts is used as the primary heater 19. A halogen heater of 400 watts is used as the secondary heater 21. When the secondary heater to heat the pressing member is employed, a power supply is arranged such that the power supplied to the primary heater heating the fixing member is higher than that supplied to the secondary heater heating the pressing member.

Though it is not shown in FIG. 2, an oil coater which applies a release oil to the surface of the fixing belt 15 is provided to enhance a release effect of the surface of the fixing belt 15, thereby preventing toner from adhering to the surface of the fixing belt 15.

When the toner image T on the recording material P is fixed by the above-described fixing device 4, the toner image T is not properly fixed when a surface temperature of the fixing belt 15 is too low. An uneven brightness of the toner image T arises when a surface temperature of the pressure roller 16 is too low. It has been confirmed by experiment that the above-described problems are solved in the fixing device 4 when the surface temperature of the fixing belt 15 is equal to 150° C. or greater, and when the surface temperature of the pressure roller 16 is equal to 130° C. or greater.

Thus, the target temperature of T1 for the fixing belt 15 is set at 150° C. while that of T2 for the pressure roller 16 is set at 130° C. when a toner image is fixed by the fixing device 4. Because the target temperature of the fixing belt 15 is higher than that of the pressure roller 16, the power to be supplied to the primary heater 19 is higher than that to be supplied to the secondary heater 21 so that the primary and secondary heaters 19 and 21 heat efficiently with limited electric power.

When a power switch of an image forming apparatus is turned on, the primary and the secondary heaters 19 and 21 are energized. At startup of the fixing device 4, the power supplies to the primary and the secondary heaters 19 and 21 are controlled until the fixing belt 15 and the pressure roller 16 are stably maintained at around the target temperatures of T1 and T2, respectively. Conventionally, the fixing belt 15 and the pressure roller 16 start a pre-rotation when the fixing belt 15 reaches the target temperature of T1.

Figure 8:
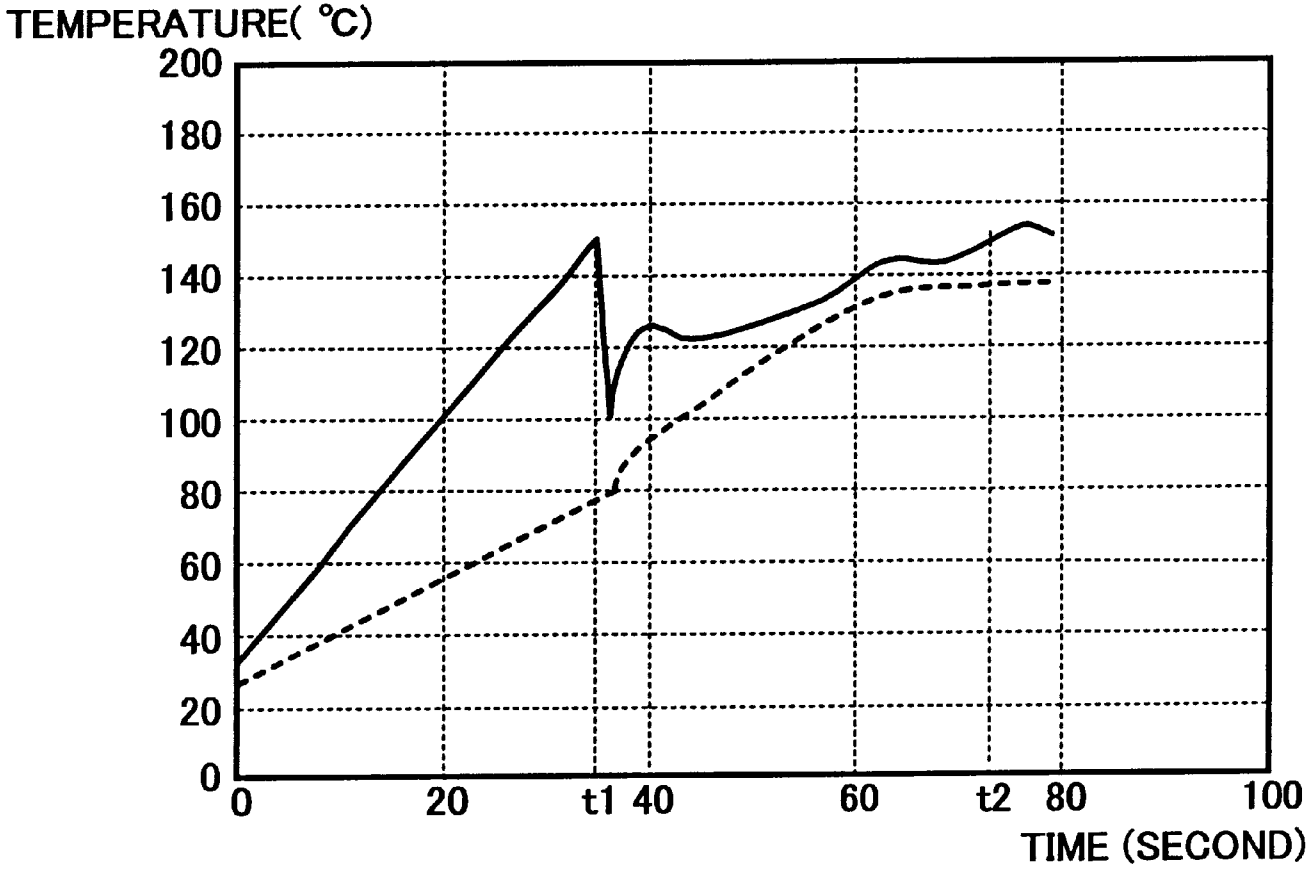
FIG. 8 PRIOR ART
FIG. 8 is a graph showing a change in temperatures of the fixing belt and the pressure roller at the startup of a prior art fixing device.

FIG. 8 illustrates an example of a startup of a prior art fixing device. The x-axis represents time while the y-axis represents surface temperatures of the fixing belt 15 and the pressure roller 16. A solid line shows the surface temperature of the fixing belt 15, and a dotted line shows the surface temperature of the pressure roller 16 (which is same in FIGS. 4 through 6).

As is shown in FIG. 8, the temperatures of the fixing belt 15 and the pressure roller 16 continuously increase when the power is turned on and the primary and the secondary heaters 19 and 21 are energized. When the thermistor 20 detects that the surface temperature of the fixing belt 15 reaches the target temperature of T1 that is 150° C. (i.e., at the time t1), the pressure roller 16, the opposing roller 17, the heating roller 18 and the fixing belt 15 start to rotate in the above-described respective directions. This pre-rotation of the pressure roller 16 and the fixing belt 15 makes their temperatures more uniform.

A proportion of the power supplied to the secondary heater 21, which heats the pressure roller 16, is lower than that of the power supplied to the primary heater 19, which heats the fixing belt 15. Further, a heat capacity of the pressure roller 16 is larger than that of the fixing belt 15. Therefore, the temperature of the pressure roller 16 is lower than that of the fixing belt 15 when the temperature of the fixing belt 15 reaches the target temperature of T1 (i.e., at the time t1). This tendency becomes more apparent when the secondary heater 21 is not provided.

Therefore, when the fixing belt 15 and the pressure roller 16 start the pre-rotation, the temperature of the fixing belt 15 rapidly decreases as shown in FIG. 8 because heat of the fixing belt 15 is largely absorbed by the pressure roller 16. By continued energization of the primary and secondary heaters 19 and 21, the fixing belt 15 reaches the target temperature of T1 (i.e., 150°C.) and the pressure roller 16 reaches the target temperature of T2 (i.e., 130°C.) at the time t2 in FIG. 8. Then, the startup of the fixing device 4 is finished. In this condition of the fixing device 4, the recording material P is conveyed between the fixing belt 15 and the pressure roller 16 so that a fixing operation of a toner image is performed.

As described above, conventionally, the fixing belt 15 and the pressure roller 16 start a pre-rotation when the fixing belt 15 reaches the target temperature of T1. With this control system, a longer period of time is required for a standby (i.e., the period of time until t2 is required to complete a startup operation after power is turned on). According to the example shown in FIG. 8, 73 seconds is required for the standby.

In the fixing device 4 according to an example of the present invention, the startup temperature of T01 of the fixing belt 15 is set at a higher temperature than the target temperature of T1, in a startup operation of the fixing device 4. When the primary thermistor 20 detects that the surface temperature of the fixing belt 15 reaches the startup temperature of T01, the fixing belt 15 and the pressure roller 16 start a pre-rotation.

Figure 4:
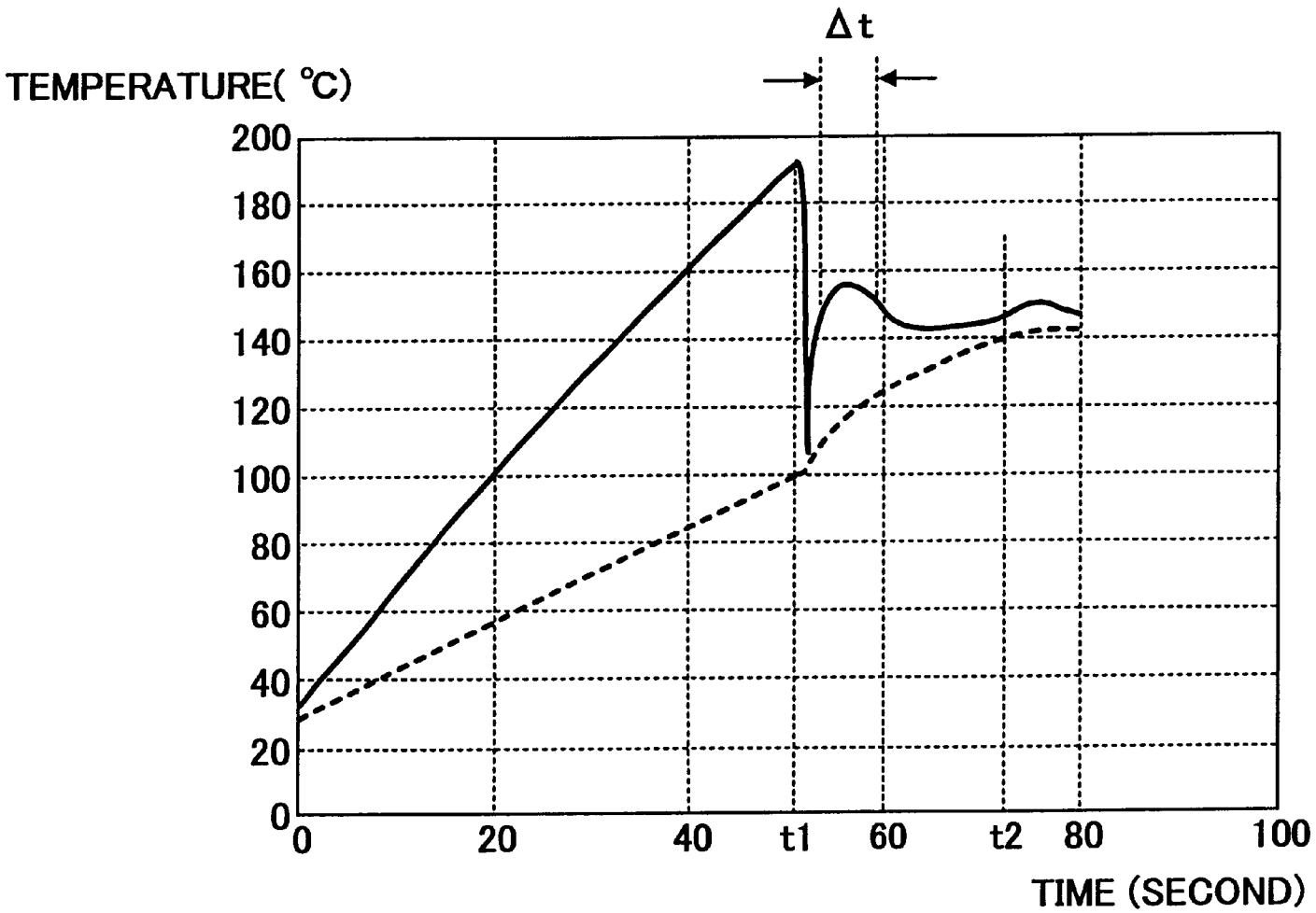
FIG. 4 is a graph showing an example of a change in temperatures of a fixing belt and a pressure roller at the startup of the fixing device.

FIG. 4 shows an example of the fixing device 4. When a power switch of an image forming apparatus is turned on, the primary and the secondary heaters 19 and 21 are energized. Then, surface temperatures of the fixing belt 15 and the pressure roller 16 increase. At this time, the pressure roller 16 is not driven and the fixing belt 15 is kept stopped.

When the thermistor 20 detects that the surface temperature of the fixing belt 15 reaches the startup temperature of T01 (i.e., 190° C., that is higher than the target temperature of T1 by 40° C.) at the time t1 in FIG. 4, the detection signal is transmitted to the CPU 24 in FIG. 3. A motor 31 starts rotating based on an initiation signal for the rotation output by the CPU 24. The pressure roller 16 is then rotatably driven in a counterclockwise direction in FIG. 2. The fixing belt 15 rotates in a direction indicated by an arrow A. Thus, the fixing belt 15 and the pressure roller 19 start a pre-rotation. A reference numeral 32 designates a driver for the motor 31.

According to an example illustrated in FIG. 4, the primary heater 19 is energized until it is detected that the surface temperature of the fixing belt 15 reaches the startup temperature of T01 (i.e., 190° C.). A setting temperature of the fixing belt 15 is switched to the target temperature of T1 at the same time when the pre-rotation is started. The energization of the primary heater 19 is then controlled so that the fixing belt 15 reaches the target temperature of T1 (i.e., 150° C.). The secondary heater 21 is energized until a startup operation of the fixing device 4 is finished (i.e., at the time t2) from the beginning of the startup operation.

When the fixing belt 15 and the pressure roller 16 start a pre-rotation, the surface temperature of the fixing belt 15 rapidly decreases because heat of the fixing belt 15 is absorbed by the pressure roller 16. The temperature of the fixing belt 15 then increases again due to the heating by the primary heater 19. Thus, the fixing belt 15 is maintained in the vicinity of the target temperature T1 (i.e., 150° C.).

The temperature of the pressure roller 16 also increases after the pressure roller 16 starts the pre-rotation, due to an application of heat by the secondary heater 21 and a transfer of heat from the fixing belt 15. When the secondary thermistor 22 detects that the surface temperature of the pressure roller 16 is equal to the target temperature of T2 (i.e., 130° C.) or higher, and also when the secondary thermistor 22 detects that the surface temperature of the fixing belt 15 reaches the target temperature of T1 (i.e., 150° C. at the time t1 in FIG. 4), the startup of the fixing device 4 is finished. Then, the energization of the secondary heater 21 is also controlled so that the surface temperature of the pressure roller 16 reaches the target temperature of T2. The temperatures of the fixing belt 15 and the pressure roller 16 are thus controlled to reach the target temperatures of T1 and T2, respectively.

When the startup of the fixing device 4 is completed, a fixing operation of a toner image is performed. For example, the pressure roller 16 and the fixing belt 15 first stop the pre-rotation. Then, the pressure roller 16 and the fixing belt 15 start rotating to perform the fixing operation. The recording material P is conveyed between the fixing belt 15 and the pressure roller 16 so that the toner image is fixed.

According to the example described referring to FIG. 4, the primary heater to heat the fixing member is energized such that the fixing member has a startup temperature that is higher than a target temperature at startup of the fixing device 4 by 40° C. Rotations of the fixing member and the pressing member are controlled such that the fixing member and the pressing member start a pre-rotation when the primary temperature detector for the fixing member detects that the temperature of the fixing member reaches the startup temperature.

At the startup of the fixing device 4, the temperature of the fixing belt 15 increases to the temperature of T01 that is higher than the target temperature of T1 for fixing a toner image. Then, the fixing belt 15 and the pressure roller 16 start a pre-rotation, thereby reducing the standby period (i.e., until t2) required for the startup of the fixing device 4. In the fixing device 4 according to an example of the present invention, the secondary heater 21 is continuously energized from start to finish of the startup of the fixing device 4, thereby quickly increasing the temperature of the pressure roller 16, resulting in an effective reduction of a standby period.

Table 1 shows an experimental result of a standby period required when the startup temperature of T01 is set at 160, 170, 180, and 190° C. Table 1 proves that the standby period is reduced by several seconds in comparison with a conventional fixing device in which a temperature of the fixing belt 15 is not increased at startup of a fixing device to a temperature that is higher than a target temperature for fixing a toner image.

TABLE 1

| Startup temperature (° C.) | Standby period (seconds) |
|---|---|
| 150 (FIG. 8) | 73 |
| 160 | 71 |
| 170 | 70 |
| 180 | 70 |
| 190 | 72 |

As described above, the startup temperature of the fixing belt 15 is set at T01, which is higher than the temperature of T1 for a fixing operation in a fixing device according to an example of present invention. The fixing device 4 includes a controller. The controller controls the fixing member including the fixing belt 15 and the pressing member including the pressure roller 16 to start a pre-rotation, when the primary temperature detector including the primary thermistor 20 detects that a temperature of the fixing belt 15 reaches the startup temperature of T01. The microcomputer 23, which includes the CPU 24 in FIG. 3, serves as the above-described controller.

With the above-described configuration, a standby period at startup is reduced with given electric power without adding a new element to a conventional fixing device.

As shown in Table 1, the standby period is effectively reduced when the startup temperature of T01 is maintained at 180° C., which is higher than the target temperature of T1 by 30° C. When the startup temperature of T01 is set at 190° C. (as shown in FIG. 4 as well), a longer standby period than that when the T01 is set at 180° C. is required (the standby period is 70 seconds at the startup temperature of 180° C. while it is 72 seconds when the startup temperature is set at 190° C). A reason for the above-described experimental result may be assumed as follows.

According to an example shown in FIG. 4, a setting of the temperature of the fixing belt 15 is switched to the target temperature of T1 (i.e., 150° C.) as soon as the temperature of the fixing belt 15 reaches the startup temperature of T01 (i.e., 190° C.). Therefore, when it is detected that the temperature of the fixing belt 15 exceeds 150° C. immediately after the setting of the temperature of the fixing belt 15 is switched to the target temperature of T1, power to the primary heater 19 is interrupted.

However, the heat of the fixing belt 15 is absorbed by the pressure roller 16 after the power to the primary heater 19 is interrupted because the temperature of the pressure roller 16 is still low at this time. Thus, the temperature of the fixing belt 15, which has reached the target temperature of T1 (i.e., 150° C.), falls below the target temperature of T1 again. t i n FIG. 4 indicates a period of time during which power to the primary heater 19 is interrupted. Thus, a longer standby period is required when the setting of the temperature of the fixing belt 15 is switched to the target temperature of T1 as soon as the temperature of the fixing belt 15 reaches the startup temperature of T01.

When the startup temperature of T01 is set as high as 190° C., a longer period of time is required before the temperature of the fixing belt 15 reaches the startup temperature of T01 (i.e., 190° C.). As a result, a comparatively long period of 72 seconds is required for the standby period as shown in Table 1.

At the startup of the fixing device 4, a setting of a temperature of the fixing member including the fixing belt 15 is not switched to the target temperature of T1 when it is detected that the temperature of the fixing member reaches a startup temperature, and the pressing member including the pressure roller 16 and the fixing member start a pre-rotation. A power supply to the heater including the primary heater 19 continues after the fixing member and the pressing member start the pre-rotation, thereby reducing a standby period of the fixing device 4. The temperature of the fixing belt 15 does not fall below the target temperature of T1 again even though heat of the fixing belt 15 is absorbed by the pressure roller 16 because the primary heater 19 keeps on applying heat to the fixing belt 15 even immediately after the fixing belt 15 and the pressure roller 16 start the pre-rotation.

Figure 5:
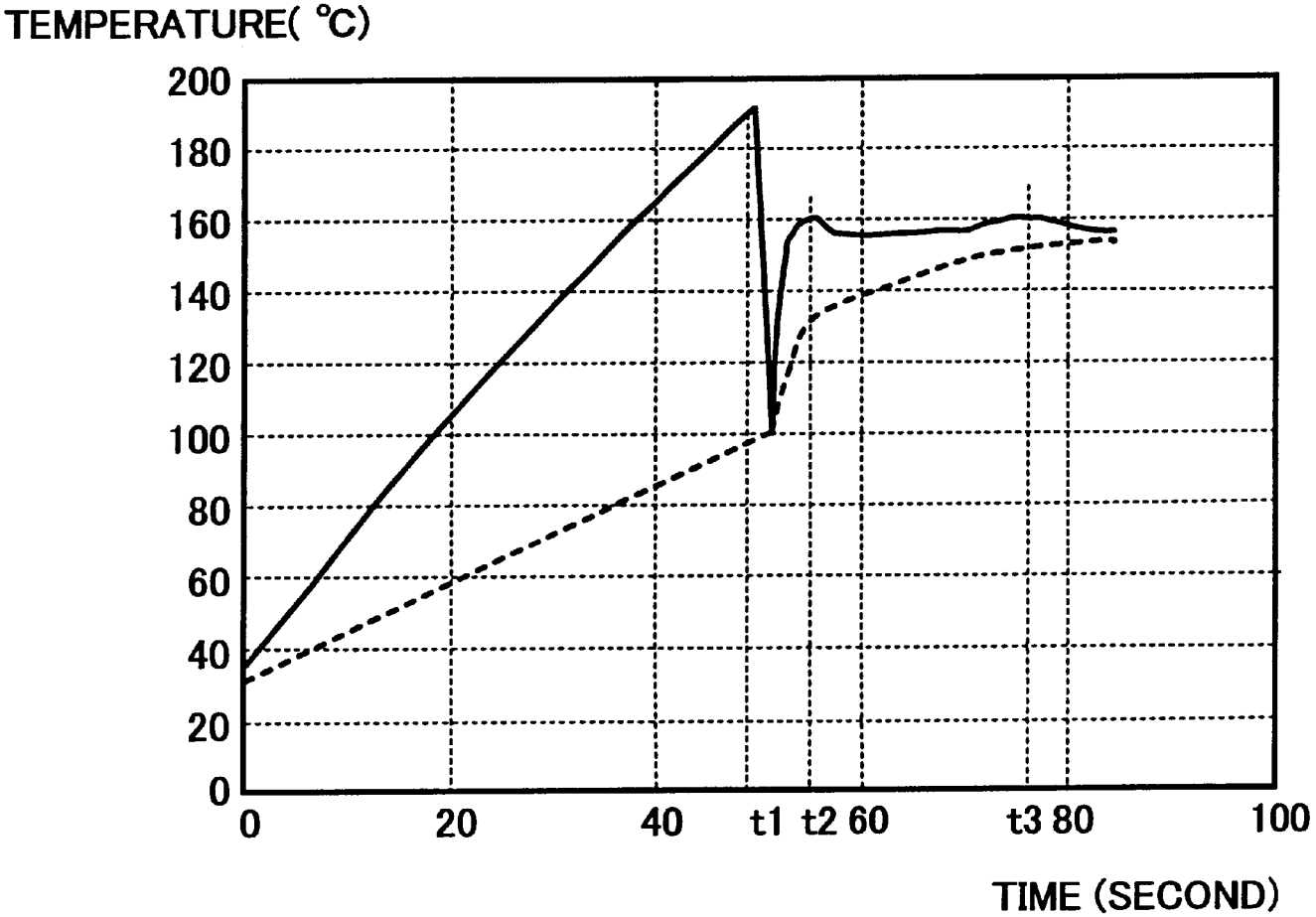
FIG. 5 is a graph showing an another example of the change in temperatures of the fixing belt and the pressure roller at the startup of the fixing device.

FIG. 5 illustrates an example of above-described fixing device 4. The primary and the secondary heaters 19 and 21 are energized at the same time when a startup operation of the fixing device 4 is started. The fixing belt 15 and the pressure roller 16 start a pre-rotation when the primary thermistor 20 detects that the temperature of the fixing belt 15 reaches the startup temperature of T01 (i.e., 190° C.) at the time t1. The setting temperatures of the fixing belt 15 and the pressure roller 16 are switched to the target temperatures of T1 and T2, respectively at the time t3, without interrupting the energization of the primary heater 19.

The primary and the secondary heaters 19 and 21 are energized from the beginning of the startup operation to the time of t3. Thereafter, the energization of the primary and the secondary heaters 19 and 21 is controlled so that the surface temperatures of the fixing belt 15 and the pressure roller 16 reach the respective target temperatures of T1 and T2. As is seen in FIG. 5, the standby period of t2, in which the temperature of the fixing belt 15 becomes equal to the target temperature of T1 (i.e., 150° C.) or higher and the temperature of the pressure roller 16 reaches the target temperature of T2 (i.e., 130° C.), is 55 seconds, resulting in a reduction of the standby period by 18 seconds when compared to a conventional fixing device.

Table 2 shows an experimental result of a standby period required when the startup temperature of T01 is set at 70, 180, 190, and 200° C. As illustrated in FIG. 5, power is continued to be primary heater 19 even when the temperature of the fixing belt 15 reaches each startup temperature.

TABLE 2

| Startup temperature (° C.) | Standby period (seconds) |
|---|---|
| 170 | 68 |
| 180 | 65 |
| 190 | 55 |
| 200 | 56 |

From the result in Table 2, it can be understood that the standby period is effectively reduced when the startup temperature of T01 is set at a temperature that is higher than the target temperature of T1 by not less than 30-degree in centigrade (i.e., 180, 190 and 200° C. in Table 2), preferably by not less than 40° C. than 40° C.

According to an example described referring to FIG. 4, the setting of the temperature of the fixing belt 15 is immediately switched to the target temperature of T1 (i.e., 150° C.) when it is detected that the temperature of the fixing belt 15 reaches the startup temperature of T01 (i.e., 190° C.). According to an example described referring to FIG. 5, the setting temperatures of the fixing belt 15 and the pressure roller 16 are switched to the respective target temperatures of T1 and T2 at the time t3 after the temperature of the fixing belt 15 is detected to be the startup temperature of T01 (i.e., 190° C.). However, the switching of the setting temperature to the target temperature can instead be determined in the following manner.

According to an example of the present invention, the secondary heater 21 to heat the pressing member including the pressure roller 16, and the secondary thermistor 22 to detect a temperature of the pressing member are provided.

Energization of the primary heater to heat the fixing member is controlled such that the temperature of the fixing member reaches the target temperature by switching the setting temperature of the fixing member to the target temperature from the startup temperature when the secondary temperature detector for the pressing member detects that the temperature of the pressing member reaches a predetermined switching temperature (i.e., a temperature at which the temperature of the pressing member reaches the target temperature, that is, at t3 in FIG. 5), after the fixing member and the pressing member start a pre-rotation and each temperature of the fixing member and the pressing member is detected to be the respective target temperatures or higher.

Further, energization of the secondary heater to heat the pressing member is controlled such that the temperature of the pressing member reaches the target temperature by switching the setting temperature of the pressing member to the target temperature from the above-described switching temperature, after the fixing member and the pressing member start a pre-rotation and each temperature of the fixing member and the pressing member is detected to reach the respective target temperature or higher, and when the secondary temperature detector for the pressing member detects that the temperature of the pressing member reaches the switching temperature (i.e., at t3 in FIG. 5).

It is preferable that the above-described switching temperature is set to be higher than the target temperature of the fixing member. According to an example shown in FIG. 5, the switching temperature is set to the target temperature of T1 (i.e., 150° C.). The setting temperature of the fixing belt 15, which has been heated by the primary heater 19, is switched from the startup temperature (i.e., 190° C.) to the target temperature of T1 (i.e., 150° C.) when the secondary thermistor 22 detects that the temperature of the pressure roller 16 reaches the switching temperature (i.e., 150° C.) at the time t3 after the pressure roller 16 starts the pre-rotation. At the same time, the setting temperature of the pressure roller 16, which has been heated by the secondary heater 21, is switched to the target temperature of T2 (i.e., 130° C.). Thereafter, energization of the primary and the secondary heaters 19 and 21 is controlled such that the temperatures of the fixing belt 15 and the pressure roller 16 reach the respective target temperatures of T1 and T2.

As described above, the setting temperatures of the fixing belt 15 and the pressure roller 16 are switched to the target temperatures of T1 and T2 when the temperature of the pressure roller 16 reaches a high switching temperature which is equal to the target temperature of the fixing belt 15 (i.e., 150° C.) or higher. Therefore, a decrease in the temperature of the fixing belt 15 after the pre-rotation of the fixing belt 15 is retarded, resulting in an effective reduction of time required for startup of a fixing device, i.e., in a reduction of the time t2.

The switching temperature can be set equal to the target temperature of the pressing member or higher. According to an example shown in FIG. 6, the primary and the secondary heaters 19 and 21 are energized at the same time when power is turned on to increase the temperatures of the fixing belt 15 and the pressure roller 16. The fixing belt 15 is heated without interrupting the energization of the primary heater 19 when the temperature of the fixing belt 15 reaches the startup temperature of T01 (i.e., 190° C.) at the time of t1. At the same time, the secondary heater 21 keeps heating the pressure roller 16, and the fixing belt 15 and the pressure roller 16 start a pre-rotation at the time t1, which are the same operations as performed in the example shown in FIG. 5.

Figure 6:
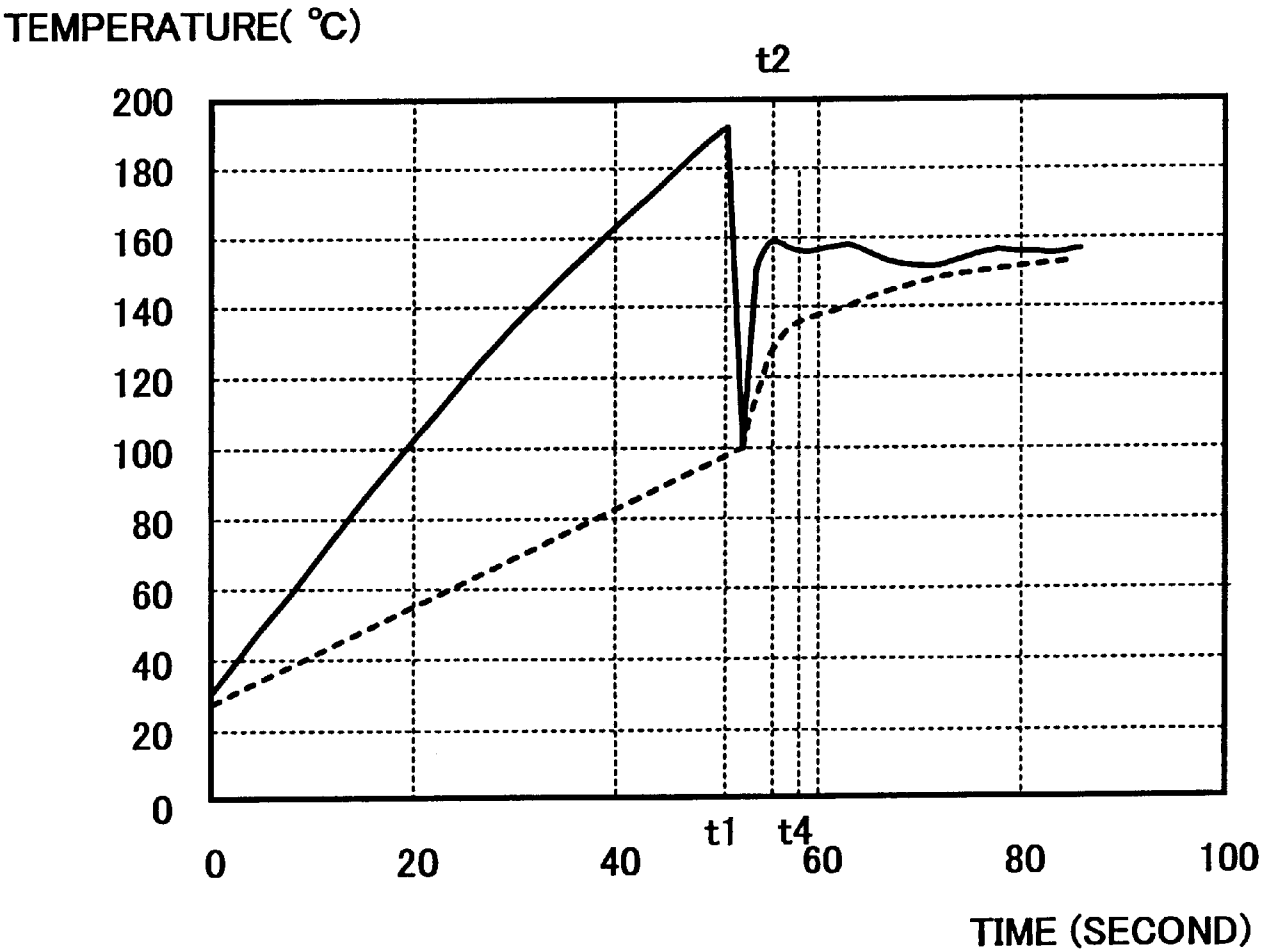
FIG. 6 is a graph showing an another example of the change in temperatures of the fixing belt and the pressure roller at the startup of the fixing device.

According to an example shown in FIG. 6, the switching temperature of the pressure roller 16 is set at a temperature equal to the target temperature of the pressure roller 16, that is a T2 of 130° C. or higher (the switching temperature is 135° C. according to an example shown in FIG. 6). The setting temperature of the fixing belt 15, which has been heated by the primary heater 19, is switched from the startup temperature (i.e., 190° C.) to the target temperature of T1 (i.e., 150° C.), when the secondary thermistor 22 detects that the temperature of the pressure roller 16 reaches the switching temperature (i.e., 135° C.) at the time of t4 after the fixing belt 15 and the pressure roller 16 start a pre-rotation.

At the same time, the setting temperature of the pressure roller 16, which has been heated by the secondary heater 21, is switched to the target temperature of T2 (i.e., 130° C.) from the switching temperature (i.e., 135° C.). Thereafter, the energization of the primary and secondary heaters 19 and 21 is controlled such that the temperatures of the fixing belt 15 and the pressure roller 16 are maintained at the respective target temperatures of T1 and T2. According to this example, the standby time of t2, during which the temperatures of the fixing belt 15 and the pressure roller 16 reach respective target temperatures of T1 (i.e., 150° C.) and the T2 (130° C.), is 55 seconds.

As described above, the switching temperature of the pressure roller 16 is set at a temperature equal to the target temperature of the pressure roller 16 (i.e., T2) or higher at startup of the fixing device 4. The setting temperatures of the fixing member and the pressing member are switched to respective target temperatures when the temperature of the pressing member is detected to be the switching temperature after the temperature of the fixing member is detected to be the startup temperature of T01 which is higher than the target temperature of T1 and the fixing member and the pressing member start a pre-rotation. Thus, a standby time can effectively be reduced.

According to examples described in FIGS. 5 and 6, the primary and the secondary heaters 19 and 21 are energized to heat the fixing and pressing members, respectively, until: (1) the fixing belt 15 and the pressure roller 16 reach the respective target temperatures of T1 and T2, and (2) a startup of the fixing device 4 is finished at the time of t2, and then (3) the setting temperature of the fixing belt 15 is switched to the target temperature (i.e., at t3 and t4 in FIG. 5 and FIG. 6, respectively). Thus, the temperature of the fixing member does not fall below the target temperature of the T1 again during a period of time in which the setting temperature of the fixing member is switched to the target temperature after the startup operation is completed as the fixing member is heated, and less heat is conveyed from the fixing member to the pressing member, thereby effectively reducing a standby period.

Because the above-described fixing device includes the fixing belt 15 as the fixing member, a heat capacity of the fixing belt 15 can be made smaller. When the present invention is applied to a fixing device using a fixing belt, a standby period can effectively be reduced because a temperature of the fixing belt can be increased to a target temperature in a comparatively short period of time at startup of the fixing device.

Figure 7:
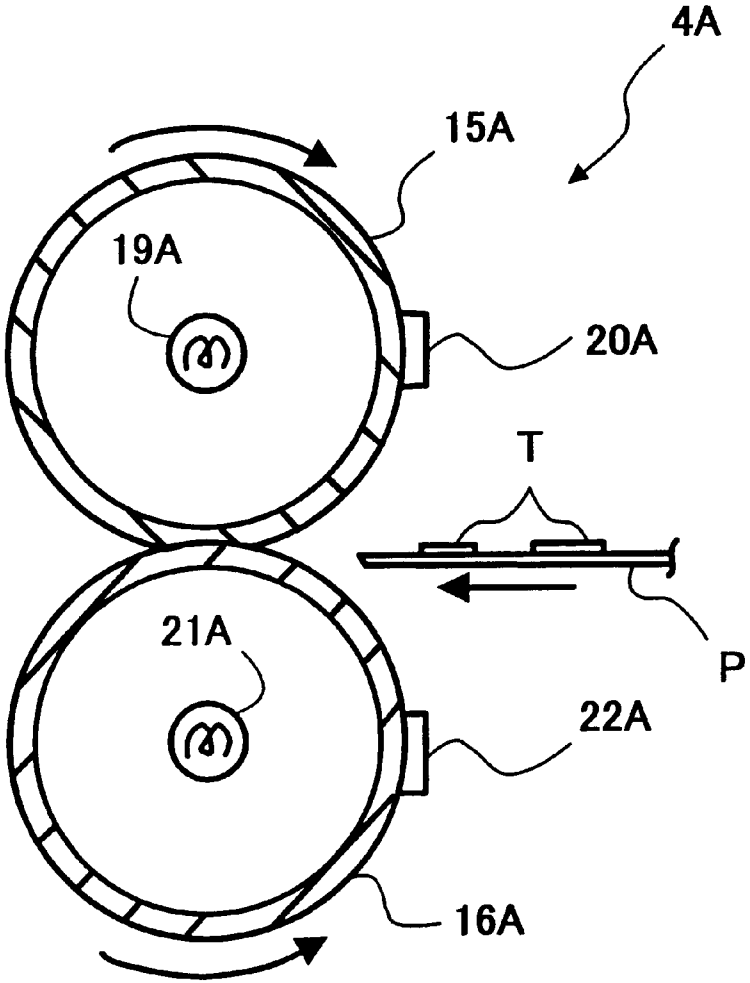
FIG. 7 is a sectional view illustrating a fixing device having a fixing roller as a fixing member and a pressure roller as a pressing member.

The present invention can also be applied generally to a fixing device having a fixing member other than a fixing belt. For example, the present invention can also be applied to a fixing device 4A illustrated in FIG. 7. The fixing device 4A includes a heater 19A provided inside of a fixing roller 15A, which is a fixing member, to heat the fixing roller 15A. A thermistor 20A is provided as a temperature detector to detect a temperature of the fixing roller 15A. A pressure roller 16A, which is a pressing member, is provided in press-contact with the fixing roller 15A. A heater 21A as a heater to heat the pressure roller 16A and a thermistor 22A, which is a temperature detector, to detect a temperature of the pressure roller 16A are provided as necessary. A recording material bearing an image passes through the nip between the rotating fixing roller 15A and the pressure roller 16A, which are rotating in a respective direction indicated by an arrow, to fix the image onto the recording material by heat and pressure.

Further, the present invention may be applied to a fixing device having a film as a fixing member.

Although an exemplary construction of an image forming apparatus including each of the above-described various types of fixing devices and an image forming device to form a toner image to be fixed by the fixing unit, is illustrated in FIG. 1, the present invention is widely applied to an image forming apparatus having a construction other than that of illustrated in FIG. 1.

Obviously, numerous additional modifications and variations of the present invention are possible in light of the above teachings. It is therefore to be understood that within the scope of the appended claims, the present invention may be practiced otherwise than as specifically described herein.

This document claims priority and contains subject matter related to Japanese Patent Application No. 2000-199806, filed on Jun. 30, 2000 and Japanese Patent Application No. 2001-150424, filed on May 21, 2001, and the entire contents thereof are herein incorporated by reference.

What is claimed as new and is desired to be secured by Letters Patent of the United States is:

1. A fixing device, comprising:

a fixing member;

a pressing member mounted to be in press-contact with said fixing member, wherein said fixing member and said pressing member are rotatable to sandwich a recording material bearing a toner image therebetween, to thereby fix the toner image onto the recording material by heat and pressure;

a primary temperature detector positioned and configured to detect a temperature of said fixing member;

a primary heater positioned and configured to heat said fixing member, wherein energization of said primary heater is controlled such that the temperature of said fixing member reaches a target temperature suitable for fixing the toner image based on a detection result of said primary temperature detector; and a controller adapted and connected to control at least said primary heater and the rotation of said fixing member and said pressing member such that at a startup of the fixing device occurs at a startup temperature of said fixing member that is higher than the target temperature, and a rotation of said fixing and pressing members is controlled such that said fixing and pressing members start a pre-rotation when said primary temperature detector detects that the temperature of the fixing member reaches the startup temperature.

2. The fixing device according to claim 1, wherein the controller is adapted to control energization of said primary heater to continue after said fixing member and said pressing member start the pre-rotation.

3. The fixing device according to claim 1, further comprising a secondary heater positioned and configured to heat said pressing member, wherein a heat output of said primary heater is greater than that of said secondary heater.

4. The fixing device according to claim 2, wherein the startup temperature of the fixing member is higher than the target temperature of the fixing member by 30° C. or greater.

5. The fixing device according to claim 3, further comprising a secondary temperature detector positioned and configured to detect a temperature of said pressing member, wherein the controller is adapted to control the energization of said primary heater such that a setting temperature of the fixing member is switched to the target temperature from the startup temperature when said secondary temperature detector detects that the temperature of the pressing member reaches a predetermined switching temperature after the fixing member and the pressing member start the pre-rotation and each temperature of the fixing member and the pressing member is detected to be the respective target temperatures or higher.

6. The fixing device according to claim 5, wherein the controller is adapted to control the energization to said secondary heater such that a setting temperature of the pressing member is switched to the target temperature from the switching temperature when said secondary temperature detector detects that the temperature of the pressing member reaches the switching temperature after the fixing member and the pressing member start the pre-rotation and each temperature of the fixing member and the pressing member is detected to be the respective target temperatures or higher.

7. The fixing device according to claim 5, wherein the controller is adapted to control the energization of said secondary heater to continue until each temperature of said fixing member and said pressing member is detected to be the respective target temperatures or higher and the setting temperature of said fixing member is switched to the target temperature.

8. The fixing device according to claim 6, wherein the controller is adapted to control the energization of said secondary heater to continue until each temperature of said fixing member and said pressing member is detected to be the respective target temperatures or higher and the setting temperature of said fixing member is switched to the target temperature.

9. The fixing device according to claim 5, wherein the controller is adapted to control the energization of said primary heater to continue until each temperature of said fixing member and said pressing member is detected to be the respective target temperatures or higher and the setting temperature of said fixing member is switched to the target temperature.

10. The fixing device according to claim 6, wherein the controller is adapted to control the energization of said primary heater to continue until each temperature of said fixing member and said pressing member is detected to be the respective target temperatures or higher and the setting temperature of said fixing member is switched to the target temperature.

11. The fixing device according to claim 5, wherein the switching temperature at which a setting temperature of the fixing member is switched to the target temperature is equal to the target temperature or higher.

12. The fixing device according to claim 6, wherein the switching temperature at which a setting temperature of the pressing member is switched to the target temperature is equal to the target temperature or higher.

13. An image forming apparatus, comprising:

an image forming device configured to form a toner image fixed by a fixing device on a recording material; and an image fixing device, comprising a fixing member; a pressing member mounted to be in press-contact with said fixing member, wherein said fixing member and said pressing member are rotatable to sandwich the recording material bearing the toner image therebetween, to thereby fix the toner image onto the recording material by heat and pressure; a primary heater positioned and configured to heat said fixing member, wherein energization of said primary heater is controlled such that the temperature of said fixing member reaches a target temperature suitable for fixing the toner image based on a detection result of said primary temperature detector; and a controller adapted and connected to control at least said primary heater and the rotation of said fixing member and said pressing member such that at a startup of the fixing device occurs at a startup temperature of said fixing member that is higher than the target temperature, and a rotation of said fixing and pressing members is controlled such that said fixing and pressing members start a pre-rotation when said primary temperature detector detects that the temperature of the fixing member reaches the startup temperature.

14. A fixing device, comprising:

fixing means;

pressing means in press-contact with said fixing means, wherein said fixing means and said pressing means sandwich a recording material bearing a toner image therebetween while rotating to fix the toner image onto the recording material by heat and pressure;

primary temperature detector means for detecting a temperature of said fixing means;

primary heater means for heating said fixing means such that the temperature of said fixing means reaches a target temperature suitable for fixing a toner image based on a detection result of said primary temperature detector means; and means for controlling said fixing device such that at startup of the fixing device, the temperature of said fixing means reaches a startup temperature that is higher than the target temperature, and said fixing and pressing means start a pre-rotation when said primary temperature detector means detects that the temperature of the fixing means reaches the startup temperature.

15. The fixing device according to claim 14, wherein the energization to said primary heater means is controlled to continue after said fixing means and said pressing means start the pre-rotation.

16. The fixing device according to claim 14, further comprising a secondary heater means for heating said pressing means, wherein a higher proportion of power is supplied to said primary heater means than to said secondary heater means.

17. The fixing device according to claim 14, wherein the startup temperature of the fixing means is higher than the target temperature of the fixing means by 30° C. or higher.

18. The fixing device according to claim 16, further comprising a secondary temperature detector means for detecting a temperature of said pressing means, wherein the energization to said primary heater means is controlled such that the temperature of said fixing means reaches the target temperature by switching a setting temperature of the fixing means to the target temperature from the startup temperature when said secondary temperature detector means detects that the temperature of the pressing means reaches a predetermined switching temperature after the fixing means and the pressing means start the pre-rotation and each temperature of the fixing means and the pressing means is detected to be the respective target temperatures or higher.

19. The fixing device according to claim 18, wherein the energization to said secondary heater means is controlled such that the temperature of said pressing means reaches the target temperature by switching a setting temperature of the pressing means to the target temperature from the switching temperature when said secondary temperature detector means detects that the temperature of the pressing means reaches the switching temperature after the fixing means and the pressing means start the pre-rotation and each temperature of the fixing means and the pressing means is detected to be the respective target temperatures or higher.

20. The fixing device according to claim 18, wherein the energization to said secondary heater means is continued until each temperature of said fixing means and said pressing means is detected to be the respective target temperatures or higher and the setting temperature of said fixing means is switched to the target temperature.

21. The fixing device according to claim 19, wherein the energization to said secondary heater means is continued until each temperature of said fixing means and said pressing means is detected to be the respective target temperatures or higher and the setting temperature of said fixing means is switched to the target temperature.

22. The fixing device according to claim 18, wherein the energization of said primary heater means is continued until each temperature of said fixing means and said pressing means is detected to be the respective target temperatures or higher and the setting temperature of said fixing means is switched to the target temperature.

23. The fixing device according to claim 19, wherein the energization of said primary heater means is continued until each temperature of said fixing means and said pressing means is detected to be the respective target temperatures or higher and the setting temperature of said fixing means is switched to the target temperature.

24. The fixing device according to claim 18, wherein the switching temperature at which a setting temperature of the fixing means is switched to the target temperature is equal to the target temperature or higher.

25. The fixing device according to claim 19, wherein the switching temperature at which a setting temperature of the pressing means is switched to the target temperature is equal to the target temperature or higher.

26. An image forming apparatus, comprising:

an image forming device configured to form a toner image fixed by a fixing device on a recording material; and a fixing device, comprising fixing means; pressing means in press-contact with said fixing means, wherein said fixing means and said pressing means sandwich a recording material bearing a toner image therebetween while rotating to fix the toner image onto the recording material by heat and pressure; primary temperature detector means for detecting a temperature of said fixing member means; primary heater means for heating said fixing means such that the temperature of said fixing means reaches a target temperature suitable for fixing a toner image based on a detection result of said primary temperature detector means; and means for controlling said fixing device such that at startup of the fixing device, the temperature of said fixing means reaches a startup temperature that is higher than the target temperature, and said fixing and pressing means start a pre-rotation when said primary temperature detector means detects that the temperature of the fixing means reaches the startup temperature.

27. A method for starting up a fixing device having a fixing member and a pressing member in press-contact with said fixing member, wherein said fixing member and said pressing member are able to sandwich a recording material bearing a toner image therebetween while rotating to fix the toner image onto the recording material by heat and pressure, a primary temperature detector to detect a temperature of said fixing member, and a primary heater to heat said fixing member, wherein energization of said primary heater is controlled such that the temperature of said fixing member reaches a target temperature suitable for fixing the toner image based on a detection result of said primary temperature detector, the method comprising the steps of:

energizing to said primary heater such that the temperature of said fixing member reaches a startup temperature that is higher than the target temperature; and rotating said fixing and pressing members such that said fixing and pressing members start a pre-rotation when said primary temperature detector detects that the temperature of the fixing member reaches the startup temperature.

28. The method according to claim 27, further comprising:

continuing the energization to said primary heater after said fixing member and said pressing member start the pre-rotation.

29. The method according to claim 27, further comprising:

providing a secondary heater configured to heat said pressing member; and supplying a higher proportion of power to said primary heater than to said secondary heater.

30. The method according to claim 29, further comprising:

providing a secondary temperature detector configured to detect a temperature of said pressing member; and energizing said primary heater such that the temperature of said fixing member reaches the target temperature by switching a setting temperature of the fixing member to the target temperature from the startup temperature.

31. The method according to claim 30, further comprising:

energizing said secondary heater such that the temperature of said pressing member reaches the target temperature by switching a setting temperature of the pressing member to the target temperature from the switching temperature.

32. The method according to claim 30, further comprising:

continuing the energization of said secondary heater until each temperature of said fixing member and said pressing member is detected to be the respective target temperatures or higher and the setting temperature of said fixing member is switched to the target temperature.

33. The method according to claim 30, further comprising:

continuing the energization of said primary heater until each temperature of said fixing member and said pressing member is detected to be the respective target temperatures or higher and the setting temperature of said fixing member is switched to the target temperature.

* * * * *